US010815772B2

(12) United States Patent
Mourre et al.

(10) Patent No.: US 10,815,772 B2
(45) Date of Patent: Oct. 27, 2020

(54) DETECTION SYSTEM FOR A WELLSITE AND METHOD OF USING SAME

(71) Applicant: National Oilwell Varco, L.P., Houston, TX (US)

(72) Inventors: Darren Mourre, Spring, TX (US); Russell C. Gilleylen, Spring, TX (US); Lance Staudacher, Houston, TX (US); Frank Benjamin Springett, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 278 days.

(21) Appl. No.: 15/550,788

(22) PCT Filed: Feb. 12, 2016

(86) PCT No.: PCT/US2016/017849

§ 371 (c)(1),
(2) Date: Aug. 13, 2017

(87) PCT Pub. No.: WO2016/130979

PCT Pub. Date: Aug. 18, 2016

(65) Prior Publication Data

US 2018/0038220 A1 Feb. 8, 2018

Related U.S. Application Data

(60) Provisional application No. 62/116,362, filed on Feb. 13, 2015.

(51) Int. Cl.
*E21B 33/064* (2006.01)
*E21B 47/002* (2012.01)
(Continued)

(52) U.S. Cl.
CPC ..... *E21B 47/092* (2020.05); *E21B 33/064* (2013.01); *E21B 47/002* (2020.05);
(Continued)

(58) Field of Classification Search
CPC .... E21B 33/064; E21B 47/0002; E21B 47/09; E21B 47/0905; E21B 47/091;
(Continued)

(56) References Cited

U.S. PATENT DOCUMENTS 3,103,976 A * 9/1963 De Vries ..... E21B 7/128 166/336
3,843,923 A * 10/1974 deVries ..... E21B 41/0014 324/228

(Continued)

FOREIGN PATENT DOCUMENTS

WO 2005/001795 A2 1/2005
WO 2013/165943 A2 11/2013

OTHER PUBLICATIONS

PCT/US2016/017849 International Search Report and Written Opinion dated Jul. 8, 2016 (17 p.).

(Continued)

*Primary Examiner* — Matthew R Buck
(74) *Attorney, Agent, or Firm* — Conley Rose, P.C.

(57) ABSTRACT

A detection system and method for a well site is provided. The well site has a surface rig and a surface unit. The surface rig is positioned about a formation and a surface unit. The detection system includes a well site component deployable from the surface rig via a conveyance, well site equipment positioned about the well site and having a bore to receive the well site component therethrough; and base units. The base units include scanners positioned radially about the bore of the well site equipment. The scanners detect an outer surface of the well site component and generate combinable (Continued)

images of the well site component whereby the well site equipment is imaged.

20 Claims, 12 Drawing Sheets

(51) Int. Cl.

| | |
|---|---|
| ***E21B 47/09*** | (2012.01) |
| ***E21B 47/092*** | (2012.01) |
| ***E21B 47/095*** | (2012.01) |
| ***E21B 47/12*** | (2012.01) |
| *E21B 33/06* | (2006.01) |

(52) U.S. Cl.
CPC ..... *E21B 47/09* (2013.01); *E21B 47/095* (2020.05); *E21B 47/12* (2013.01); *E21B 33/063* (2013.01)

(58) Field of Classification Search
CPC ..... E21B 47/12; E21B 47/002; E21B 47/092; E21B 47/095
See application file for complete search history.

(56) References Cited

U.S. PATENT DOCUMENTS

| | | | | |
|---|---|---|---|---|
| 4,674,171 | A | 6/1987 | Decell et al. | |
| 4,964,462 | A * | 10/1990 | Smith | E21B 33/06 166/255.1 |
| 5,014,781 | A * | 5/1991 | Smith | E21B 19/00 166/384 |
| 5,202,680 | A * | 4/1993 | Savage | E21B 17/006 175/40 |
| 6,012,744 | A | 1/2000 | Wilson et al. | |
| 6,478,087 | B2 * | 11/2002 | Allen | E21B 47/0001 166/250.01 |
| 6,725,924 | B2 * | 4/2004 | Davidson | E21B 33/0355 166/250.01 |
| 7,367,396 | B2 | 5/2008 | Springett et al. | |
| 7,814,979 | B2 | 10/2010 | Springett et al. | |
| 9,416,649 | B2 * | 8/2016 | Andarawis | E21B 47/0001 |
| 9,598,953 | B2 * | 3/2017 | Ringgenerg | E21B 34/045 |
| 2004/0263158 | A1 | 12/2004 | Biester et al. | |
| 2005/0055163 | A1 * | 3/2005 | Hopper | E21B 41/00 702/6 |
| 2008/0035335 | A1 | 2/2008 | Newman | |
| 2010/0243926 | A1 | 9/2010 | Weir | |
| 2011/0000670 | A1 | 1/2011 | Springett et al. | |
| 2011/0236475 | A1 | 9/2011 | Pasha et al. | |
| 2012/0160309 | A1 | 6/2012 | Kim et al. | |
| 2012/0227987 | A1 | 9/2012 | Castriotta et al. | |
| 2013/0088362 | A1 * | 4/2013 | Yates | G01V 3/00 340/854.3 |
| 2013/0275100 | A1 * | 10/2013 | Ellis | G06F 17/5009 703/2 |
| 2013/0335232 | A1 * | 12/2013 | Conway | E21B 47/13 340/850 |
| 2014/0055141 | A1 * | 2/2014 | Carlson | E21B 17/04 324/326 |
| 2016/0138385 | A1 * | 5/2016 | Cortez | E21B 47/082 166/250.01 |

OTHER PUBLICATIONS

Examination Report dated Dec. 18, 2018, for European Application No. 16708537.2 (5 p.).
Examination Report dated Jul. 16, 2019, for European Application No. 16708537.2 (6 p.).
European Search Report dated Feb. 14, 2020, for European Application No. 19211339.7 (7 p.).
Brazilian Office Action dated Jun. 19, 2020, for Brazilian Application No. BR112017017387-5 (4 p.).
English Translation of Brazilian Office Action dated Jun. 19, 2020, for Brazilian Application No. BR112017017387-5 (4 p.).

* cited by examiner

DETECTION SYSTEM FOR A WELLSITE AND METHOD OF USING SAME

CROSS-REFERENCE TO RELATED APPLICATIONS

This application is a 35 U.S.C. § 371 national stage application of PCT/US2016/017849 filed Feb. 12, 2016, and entitled "A Detection System for a Wellsite and Method of Using Same," which claims the benefit of U.S. Provisional Application No. 62/116,362, filed on Feb. 13, 2015, and entitled "Wellsite Detection System and Method of Using Same," each of which is hereby incorporated herein by reference in its entirety for all purposes.

BACKGROUND

The present disclosure relates generally to techniques for performing well site operations. More specifically, the present disclosure relates to techniques for detecting well site equipment.

Oilfield operations may be performed to locate and gather valuable subsurface fluids. Oil rigs are positioned at well sites, and downhole tools, such as drilling tools, are deployed into the ground to reach subsurface reservoirs. Once the drilling tools form a wellbore to reach a desired reservoir, casings may be cemented into place within the wellbore, and the wellbore completed to initiate production of fluids from the reservoir.

Tubular devices, such as pipes, certain downhole tools, casings, drill pipe, drill collars, tool joints, liner, coiled tubing, production tubing, wireline, slickline, and/or other tubular members and/or tools (referred to as 'tubulars' or 'tubular strings') may be deployed from the surface to enable the passage of subsurface fluids to the surface. Various deployable tools, such as logging tools, wireline tools, drill stem testers, and the like (referred to as "subsurface tools"), may also be deployed from the surface to perform various downhole operations, such as performing tests and/or measuring well site parameters. Tubulars may be measured for use in well site operations. Examples of tubulars and related techniques are provided in U.S. Patent/Application Nos. 2012/0160309 and/or 62/064,966, the entire contents of which are hereby incorporated by reference herein.

Well site equipment, such as blow out preventers (BOPs), may be positioned about the wellbore to form a seal about a tubular therein to prevent leakage of fluid as it is brought to the surface. BOPs may be annular or ram BOPs with a mechanism, such as rams or fingers, with seals to seal a tubular in a wellbore. Examples of BOPs are provided in U.S. Patent/Application Nos. 2012/0227987; 2011/0226475; 2011/0000670; 2010/0243926; U.S. Pat. Nos. 7,814,979; 7,367,396; 6,012,744; 4,674,171; and PCT Application No. 2005/001795, the entire contents of which are hereby incorporated by reference herein.

SUMMARY

In at least one aspect, the disclosure relates to a detection system for a wellsite. The wellsite has a surface rig and a surface unit. The surface rig is positioned about a formation and a surface unit. The detection system includes a wellsite component deployable from the surface rig via a conveyance, well site equipment positioned about the wellsite and having a bore to receive the wellsite component therethrough, and base units. The base units include scanners positioned radially about the bore of the wellsite equipment. The scanners detect an outer surface of the wellsite component and generate combinable images of the wellsite component whereby the wellsite equipment is imaged.

The scanners may include magnetic resonance and/or acoustic sensors. The base units may be positioned in a circular or an irregular pattern about the bore in the wellsite equipment. The detection system may also include equipment units positionable about the wellsite component.

The equipment units are coupled to the surface unit by a communication link. Each of the equipment units include an identifier disposed about the wellsite component. The scanners may include ID sensors capable of detecting the identifiers. The identifiers may include RFIDs. The equipment units may also include a sensor package to detect wellsite parameters. Each of the base units also include a communicator. The communicator may be in communication with the equipment units and/or the surface unit. Each of the equipment units and each of the base units may also include a power supply, a processor, and a memory.

The wellsite component may be a drill collar, drill pipe, casing, tool joint, liner, coiled tubing, production tubing, wireline, slickline, logging tool, wireline tool, and/or drill stem tester. The wellsite equipment may be a blowout preventer, a low marine riser package, and/or a remote operated vehicle. The wellsite component may include a deployable tool and the wellsite equipment comprises a blowout preventer. The deployable tool may be detectable by the scanners to determine a position for severing by the blowout preventer. The wellsite component may have a narrowed portion. The wellsite component may be positionable about the narrowed portion of the wellsite equipment.

In another aspect, the disclosure relates to a method of detecting a wellsite component at a wellsite. The wellsite may have a surface rig and a surface unit. The surface rig may be positioned about a formation and a surface unit. The method involves providing well site equipment with base units. Each of the base units may include a scanner positioned about a bore in the wellsite equipment. The method may also involve deploying the wellsite component through the bore in the wellsite equipment, detecting an outer surface of the wellsite component with the scanners, generating images of the wellsite component from each of the scanners, and imaging the wellsite component by combining the images from the scanners.

The method may also involve providing the wellsite component with equipment units. Each of the equipment units may include an identifier. The method may also involve detecting the identifiers with the scanners and/or engaging the wellsite equipment with the wellsite component. The engaging may involve sealing about the deployable tool. The wellsite component may include a deployable tool and the wellsite equipment comprises a blowout preventer, and the engaging may involve severing the deployable tool based on the imaging. The method may also involve adjusting a position of the wellsite component based on the imaging. The adjusting may involve positioning a narrowed portion of the wellsite component about the wellsite equipment and the engaging may involve engaging the narrowed portion of the wellsite component with the wellsite equipment.

In another aspect, the disclosure relates to a detection system for a wellsite. The wellsite has a surface rig positioned about a formation. The detection system includes a surface unit, a wellsite component deployable into from the surface rig via a conveyance, wellsite equipment positioned about the wellsite, equipment units, and at least one base unit. The equipment units are positionable about the wellsite component, and are coupled to the surface unit by a communication link. Each of the equipment units includes an identifier disposed about the wellsite component. The base unit(s) are positionable about the wellsite equipment, and include a scanner to detect the identifiers of the equipment units as it comes within proximity thereto whereby the wellsite equipment may be selectively activated to engage a desired portion of the wellsite component.

The identifiers include radio frequency identifiers. The equipment units may also include a sensor package to detect wellsite parameters. The equipment units may include a communicator. Each of the base units may include a sensor package to detect wellsite parameters. Each of the base units may include a communicator. The communicator may be in communication with the equipment units and/or the surface unit. Each of the equipment units and each of the base units may include a power supply, a processor, and a memory. The wellsite component may include a drill collar, drill pipe, casing, tool joint, liner, coiled tubing, production tubing, wireline, slickline, logging tool, wireline tool, and/or drill stem tester. The wellsite equipment may be a blowout preventer, a low marine riser package, and/or a remote operated vehicle.

The equipment units may be positionable in a recess extending into an outer surface of the wellsite component. The equipment units may have a shield disposed thereabout. The equipment units may have a connector engageable with the wellsite equipment. The equipment units may be raised about and recessed within the wellsite component. The equipment units may be disposed radially about the wellsite component. The equipment units may be disposed vertically about the wellsite component. The base units may be disposed radially about the well site equipment. The base units may be disposed vertically about the wellsite equipment.

The wellsite component may include a deployable tool and the wellsite equipment may include a blowout preventer. The identifiers may be detectable by the scanners to determine a position for severing by the blowout preventer. The wellsite component may have a narrowed portion, and the wellsite component may be positionable about the narrowed portion of the well site equipment. The base units may be positioned in a circular or an irregular pattern about a passage in the wellsite equipment, and the wellsite component may be deployable through the passage.

In another aspect, the disclosure relates to a method of detecting a wellsite component. The method involves providing the wellsite component with equipment units and providing well site equipment with at least one base units. Each of the equipment units includes an identifier and each of the base units includes a scanner. The method further involves deploying the wellsite component about the wellsite equipment via a conveyance, detecting the identifiers of the equipment units with the scanner as it comes within proximity thereto, determining a position of the wellsite component based on the detecting, and engaging the wellsite component with the wellsite equipment based on the determining.

The method may also involve adjusting a position of the wellsite equipment based on the determining. The adjusting may involve positioning a narrowed portion of the wellsite component about the wellsite equipment and wherein the engaging comprises engaging the narrowed portion of the wellsite component with the wellsite equipment. The wellsite component may include a deployable tool and the wellsite equipment may include a blowout preventer. The engaging may involve severing the deployable tool based on the determining.

Finally, in another aspect, the disclosure relates to a method of detecting a wellsite component. The method involves deploying the wellsite component about the wellsite and providing a detection system comprising equipment units and base units. The equipment units may be positionable about the wellsite component. Each of the equipment units may include an identifier. The base units may be positionable about the wellsite location. The base units may include a scanner. The method may involve determining a position of the wellsite component relative to a wellsite location by detecting the equipment units with the base units, positioning the wellsite component in a desired position relative to the wellsite location based on the determining, and activating the wellsite component based on the positioning.

The method may also involve adjusting the positioning based on the determining. The adjusting may involve comprises positioning a narrowed portion of the wellsite component about the wellsite equipment and the activating may involve severing the narrowed portion of the wellsite component with the wellsite equipment. The wellsite component may include a deployable tool and the wellsite equipment may include a blowout preventer. The activating may include severing the deployable tool based on the determining.

BRIEF DESCRIPTION OF THE DRAWINGS

A more particular description of the disclosure, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION OF THE INVENTION

The description that follows includes exemplary apparatus, methods, techniques, and/or instruction sequences that embody techniques of the present subject matter. However, it is understood that the described embodiments may be practiced without these specific details.

A wellsite detection system may be provided about a wellsite for detecting (e.g., sensing, locating, identifying, measuring, etc.) various wellsite components. The detection system may include an equipment unit and a base unit. The equipment unit may be positioned about the wellsite components, such as deployable tools including tubulars and/or other equipment. The base unit may be positioned about the wellsite (e.g., in wellsite equipment) to detect the equipment units as they pass thereby.

The equipment and/or base units may collect and/or pass stored and/or real time information about the equipment. Such information may be used, for example, to sense, identity, locate, and/or measure the wellsite component, to collect wellsite data, and/or to provide information about operating conditions. The equipment and/or the base units may be, for example, in communication with communication units positioned about downhole tools, subsea, subsurface, surface, downhole, offsite and/or other locations. Power, communication, and/or command signals may be passed about portions of the well site and/or offsite locations via the detection system.

Figure 1:
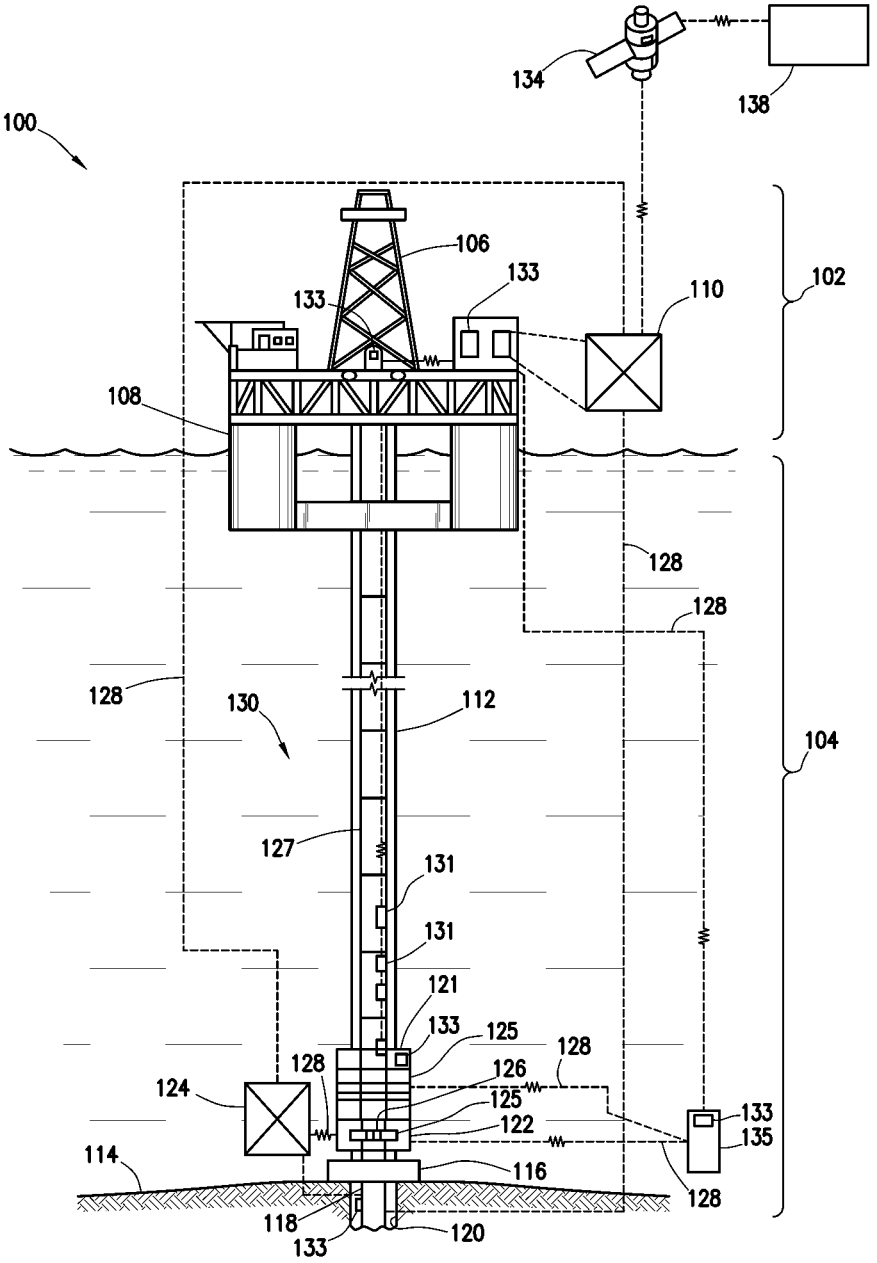
FIG. 1 depicts a schematic view of an offshore wellsite having a surface system and a subsurface system, the wellsite having wellsite detection systems thereabout.

FIG. 1 depicts an offshore wellsite 100 including a surface system 102 and a subsurface system 104. The surface system 102 may include a rig 106, a platform 108 (or vessel), and a surface unit 110. The surface unit 110 may include one or more units, tools, controllers, processors, databases, etc., located at the platform 108, on a separate vessel, and/or near to or remote from the wellsite 100. While an offshore wellsite is depicted, the wellsite may be land based.

The subsurface system 104 includes a conduit 112 extending from the platform 108 to a sea floor 114. The subsurface system 104 further includes a wellhead 116 with a tubular 118 extending into a wellbore 120, a low marine riser package (LMRP) 121 with a BOP 122, and a subsea unit 124. The BOP 122 has a BOP assembly 125 with sealing devices 126 for shearing and/or sealing the wellbore 120.

A wellsite component 127 is deployed through the conduit 112 and to the BOP 122. In the example shown, the wellsite component 127 is a deployable tool including a series of tubulars 118 threaded together to form a drill string. A detection system 130 is provided for detecting the wellsite component 127. The detection system 130 includes equipment units 131 positioned about the wellsite component 127 and base units 133 positioned about the wellsite 100.

In the example shown, the equipment units 131 are provided at various locations about the wellsite component 127. The base units 133 are provided at various locations about the rig 106, the surface unit 110, BOP 122, and tubulars 118. As also shown, the base unit 133 may be carried by other devices, such as a remote operated vehicle (ROV) 135 deployed from the platform 108. The various base units 133 may form a wired or wireless connection with one or more of the equipment units 131.

The surface system 102 and subsurface system 104 may be provided with one or more communication units, such as the surface unit 110 and/or the subsea unit 124, located at various locations to work with the surface system 102 and/or the subsurface systems 104. Communication links 128 may be provided for communication of power, control, and/or data signals between the equipment and base units and various wellsite locations 100 and/or offsite locations 138. The communication links 128 may be wired or wireless connections capable of passing communications between the various units. As shown, communications may also be conveyed by a satellite 134 or other means.

While an example configuration is depicted, it will be appreciated that one or more equipment units, base units, wellsite components, communication units, communication links, and/or other options may be provided for detecting the well site equipment about various parts of the well site.

Figure 2:
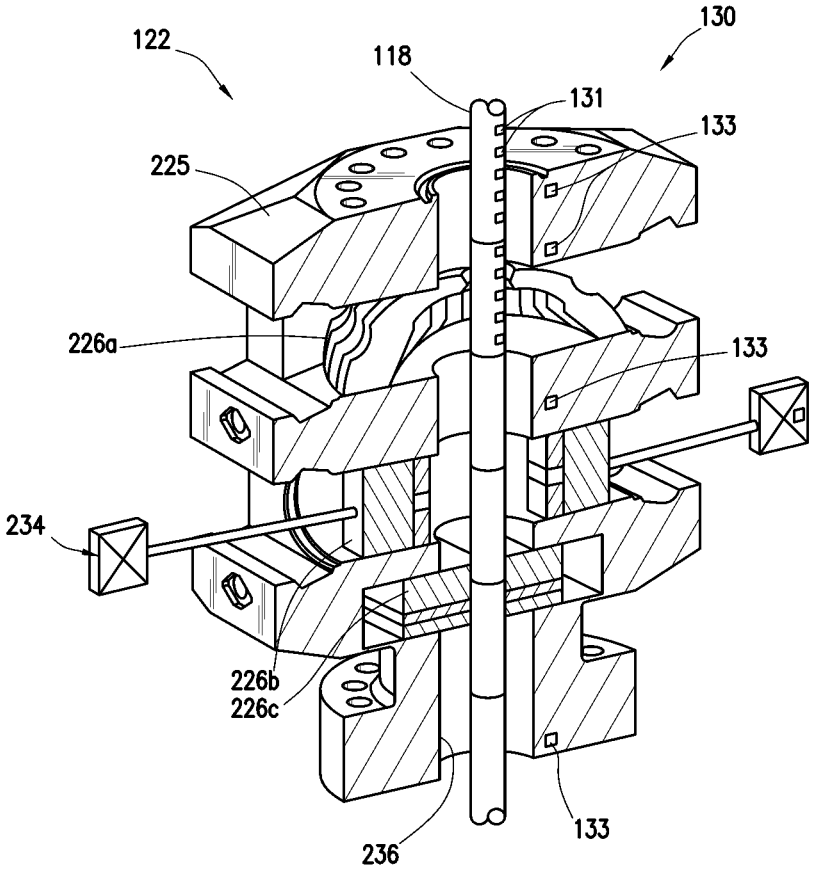
FIG. 2 is a vertical cross-sectional view of the wellsite detection system usable with a blowout preventer.

FIG. 2 depicts an example of use of the detection system 130. In this example, the equipment units 131 are positioned in the tubular 118 and the base units 133 are positioned in the BOP 122. As shown, the BOP 122 includes a housing 225 with multiple sealing means, including fingers (or annulars) 226*a* of an annular BOP, rams 226*b* of a ram BOP, and a blade 226*c* of a guillotine BOP. The various sealing means may have seals, blades, and/or sealing devices capable of sealing the BOP 122.

The sealing means 226*a-c* are activated by actuators 234, which may be one or more hydraulic, electrical or other actuators capable of selectively activating the sealing means to sever and/or seal about the tubular 118. One or more sealing means, actuators and/or other devices may be provided about the BOP. Examples of sealing means that may be present are provided in US Patent Nos. 2012/0227987; 2011/0226475; 2011/0000670; 2010/0243926; U.S. Pat. Nos. 7,814,979; and 7,367,396, previously incorporated by reference herein.

The tubular 118 extends through a passage 236 in the housing 225. The sealing means 226*a,b* are positionable in the passage 236 of the housing 225 and selectively movable into engagement with the tubular 118 for sealing and/or severing the tubular 118. The actuators 234 may be selectively activated by units (e.g., 110, 124 of FIG. 1). The sealing means 226*a-c* may extend for engagement within the BOP 122 with or without contact with the tubular 118 to form a seal about the passage 236. The sealing means 226*a-c* may include, for example, fingers, blades, seals, or other devices for sealing about tubular 118 and/or passage 236.

The tubular 118 may have one or more of the equipment units 131 thereabout. The BOP 122 may have one or more base units 133 positionable thereabout. The equipment units 131 are detectable by the base units 133. Individual base units 133 may detect the equipment units 131 and communicate therewith as the equipment units 131 pass thereby. The equipment and base units 131,133 may pass data, power, communication, and/or other signals therebetween.

The equipment and base units 131, 133 may exchange information, such as equipment information, measurement data, and/or other information. The base units 133 may collect, store, and/or process the information received from the equipment units 131. The base units 133 may also contain and/or collect information about the wellsite, wellsite operations, equipment, and/or other information.

While FIG. 2 shows the equipment and base units 131, 133 positioned in the tubular 118 and the BOP housing 225, the equipment units 131 may be in any wellsite component movable about a base unit 133, and the base unit 133 may be positioned about any location about the wellsite. The wellsite location of the base unit 133 may be a fixed member, such as portions of the LMRP 121 and/or a movable member, such as the ROV 135 of FIG. 1.

Figure 3B:
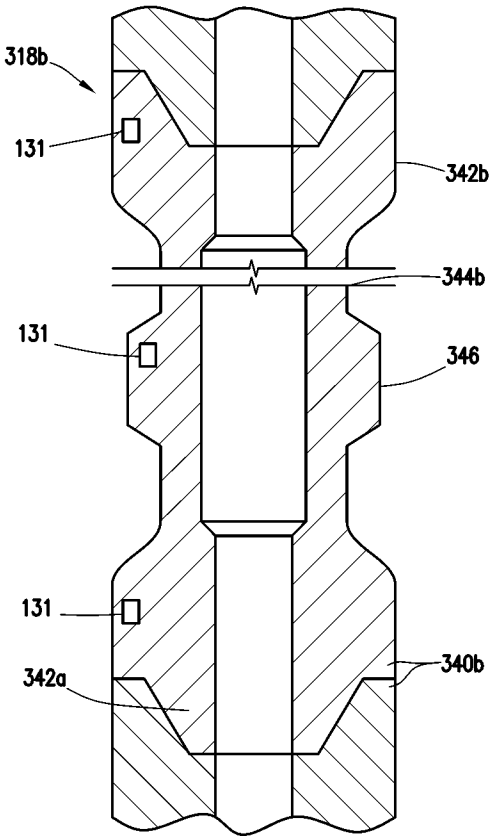
FIGS. 3A-3C are schematic views of various wellsite components with equipment units positioned thereabout.
Figure 3A:
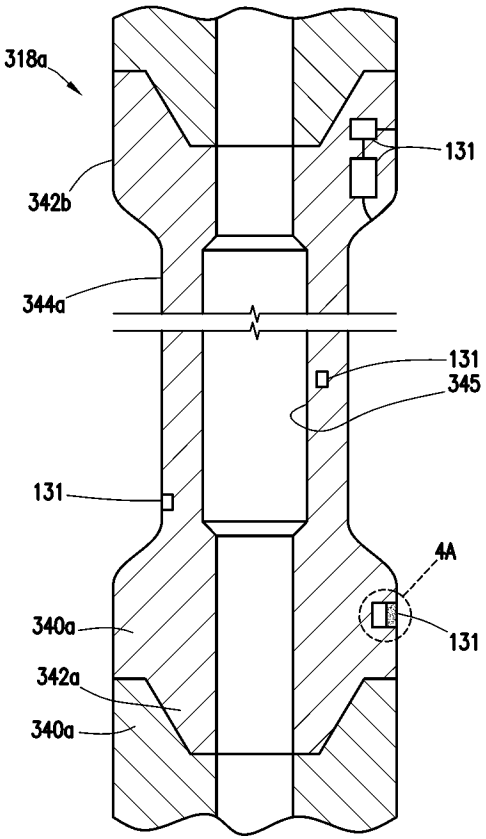
Figure 3C:
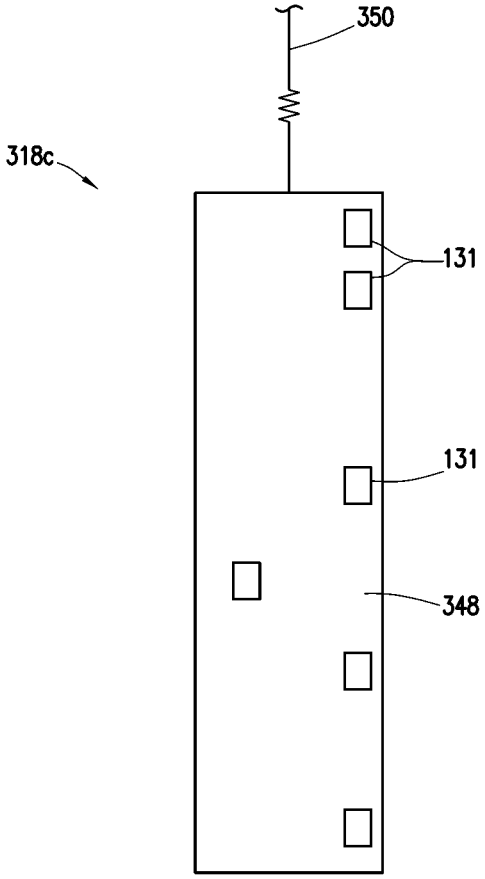

FIGS. 3A-3C show schematic views of various examples of the wellsite components 318*a-c* with the equipment units 131 disposed thereabout. FIGS. 3A and 3B show drill strings 318*a,b* with tubulars 340*a,b*, respectively. FIG. 3C shows a downhole tool 318*c*. As shown by these examples, the equipment units 131 may be positioned in various locations about a variety of deployable tools, such as downhole drilling tools, usable as the wellsite components.

FIG. 3A shows the drill string 318*a* including a series of drill pipe 340*a*. Each drill pipe 340*a* includes a pin end 342*a*, a box end 342*b*, with a tubular 344*a* therebetween and a passage 345 therethrough. The pin end 342*a* of a drill pipe 340*a* is threadedly connectable to a box end 342*b* of another drill pipe 340*a* to form the drill string 318*a*. The drill pipe 340*a* may be any drill pipe, tool joint, or other tubular deployable from the surface. Examples of tubulars are provided in US Patent/Application Nos. 6012744, 4674171, and PCT Application No. 2005/001795 previously incorporated by reference herein.

FIG. 3B shows another version of the drill string 318*b* with a series of drill pipe 340*b*. The drill pipe 340*b* is the same as the drill pipe 340*a*, except that it is provide with a raised portion 346 along the tubular 344*b*. The raised portion 346 of the tubular 344*b* has a larger diameter than the tubular 344*a*. In at least some cases, it may be desirable to identify dimensions of the tubular 344*b*, such as which portions of the tubular 344*b* are larger. This may be used, for example, to identify where to seal about the tubular 344*b* as is described herein.

As shown in FIGS. 3A-3B, the equipment units 131 may be positionable along various portions of the drill string 318*a,b*, such as the pin and box ends 342*a,b*, the tubular 344*a,b*, and/or the raised portion 346 of the drill pipe 340*a,b*, and/or various portions of the downhole tool 318*c*.

The downhole tool 318*c* is depicted as a wireline tool having a housing 348 deployable from the surface by a wireline 350. The downhole tool 318*c* may be any deployable device provided with various downhole components, such as resistivity, telemetry, logging, surveying, sampling, testing, measurements while drilling, and/or other components, for performing downhole operations. The wireline 350 may be provided with smart capabilities for passing signals between the downhole tool 318*c* and the surface (e.g., 110 of FIG. 1).

As demonstrated by the examples shown in FIGS. 3A-3C, the equipment units 131 may be positioned about a surface and/or subsurface portion of the well site components. One or more equipment units 131 may be provided in various forms and/or positions. One or more of the equipment units 131 may be unitary and/or in multiple portions. The equipment units 131 may be installed into a surface of the well site components 318*a-c*, and/or embedded within.

Figure 4B:
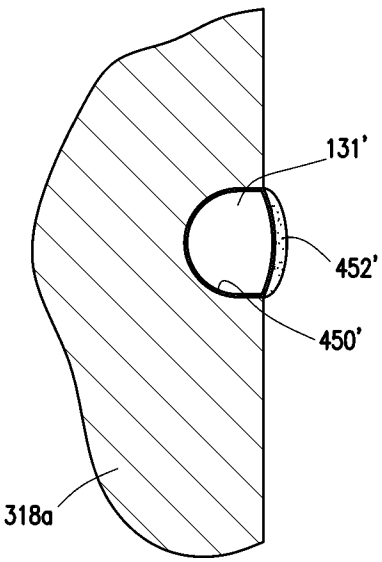
FIGS. 4A and 4B are detailed views of equipment units positioned in wellsite components.
Figure 4A:
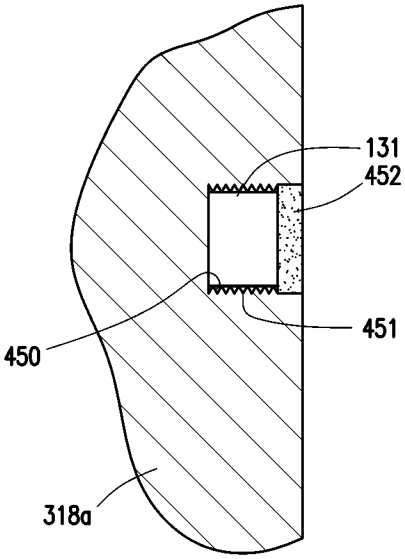

FIGS. 4A and 4B show schematic views of various configurations of placement of equipment units 131 in the wellsite component. FIG. 4A shows a portion 4A of FIG. 3A with an equipment unit 131 in a recessed position. FIG. 4B shows another version of the equipment unit 131' in a raised position.

In the recessed position of FIG. 4A, the equipment unit 131 is recessed into a pocket 450 extending into an outer surface of the wellsite component 318*a*. The equipment unit 131 may be recessed for protection from harsh conditions. The equipment unit 131 is recessed into the pocket 450 a distance from an outer surface of the wellsite component 318*a*. The equipment unit 131 is provided with a connection 451 in the form of a thread matable with a thread in the pocket 450.

A shield 452 is disposed over the equipment unit 131 about an opening of the pocket 450. The shield 452 may enclose the equipment unit 131 in the wellsite component 318*a*. The shield 452 may be, for example, an epoxy and/or other material to protect the equipment unit 131 while allowing communication therethrough.

In the raised position of FIG. 4B, the equipment unit 131' is partially recessed into a pocket 450' extending into an outer surface of the wellsite component 318*a*. The equipment unit 131' may be raised and/or extend a distance from an outer surface of the wellsite component 318*a* to facilitate communication with base units 133 located about the wellsite. A tip portion of the equipment unit 131' extends from the pocket 450' a distance from an outer surface of the wellsite component 318*a*.

A shield 452' is disposed over the wellsite component 318*a*. The shield 452' may be the same as the shield 452, except that it is shaped to permit the equipment unit 131' to extend beyond the outer surface of the wellsite component. The equipment unit 131' may be press fit in place and secured with the shield 452'.

As shown by FIGS. 4A and 4B, the equipment unit 131 may have any shape and be positioned in a correspondingly shaped pocket 450 with the shield 452 thereon. The equipment units 131 may also be secured in place using a variety of techniques, such as the connection 451 of FIG. 4A, the press fit of FIG. 4B, and/or other means. It will be appreciated that other geometries and/or materials may be provided.

Figure 5:
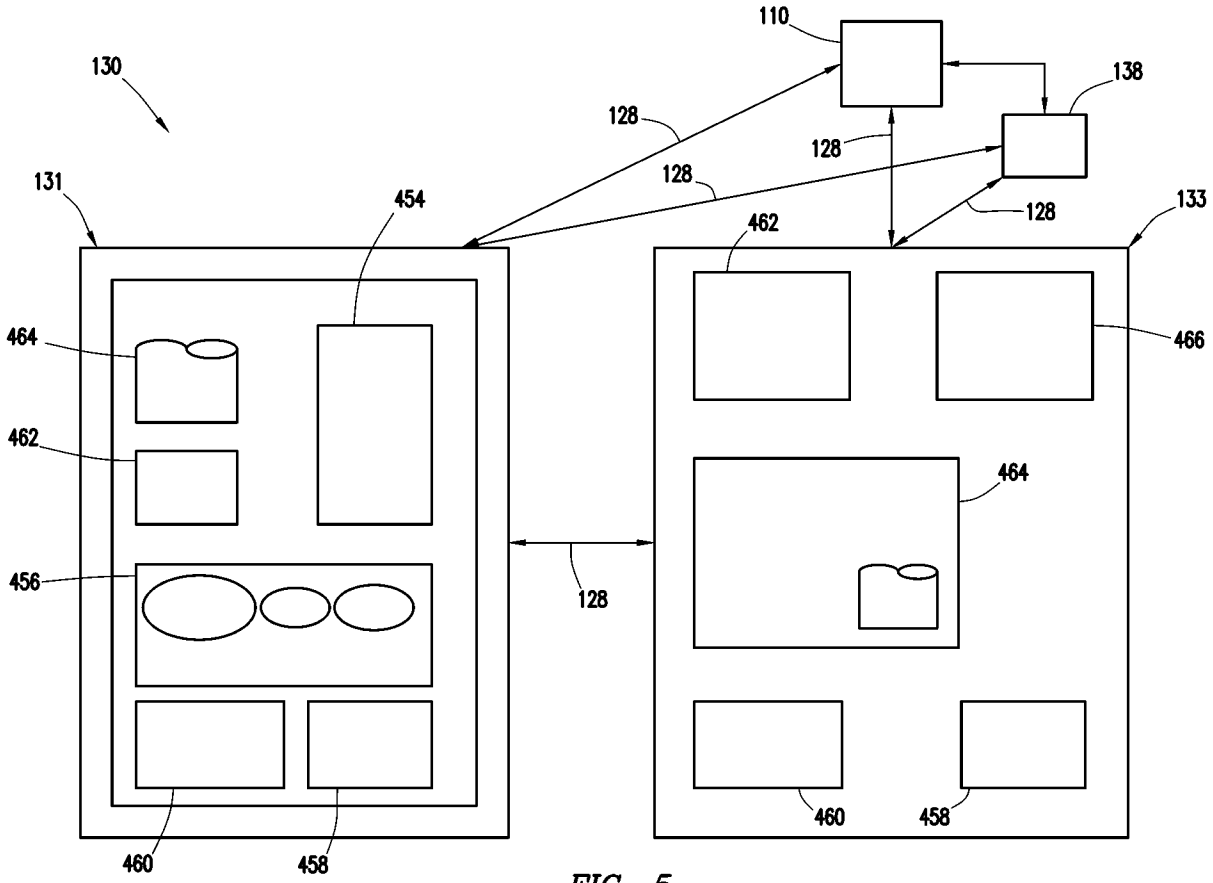
FIG. 5 is a schematic view of the wellsite detection system.

FIG. 5 is a schematic diagram depicting an electrical configuration of the detection system 130. As shown in this view, the equipment unit 131 includes an identifier 454, a sensor package 456, a power supply 458, a communicator 460, a processor 462, and a memory 464. The base unit 133 includes a power supply 458, a communicator 460, a processor 462, a memory 464, and a scanner 466.

One or more of the communication links 128 may be provided between one or more of the equipment units 131, the base units 133, surface units 110, and/or an offsite locations 138. One or two way communication may be provided by the communication links 128. The communicators 460 may be antennas, transceivers or other devices capable of communication via the communication links 128 in wellsite conditions. The communicators 460 may communicate with the surface unit 110 directly or via subsurface equipment, such as electrical cabling (e.g., mux cables along the riser) extending to the surface.

The equipment and base units 131, 133 may be provided with identifiers 454, such as radio frequency identifiers (RFIDs), capable of storing information. For example, as shown, the RFID 454 may be used to store information about the wellsite component, the wellsite, the well site operation, the client, and/or other information as desired. The RFID 454 may be readable by the scanner 466 via the communication link 128.

The equipment unit 131 and/or the base unit 133 may be provided with sensing capabilities for measuring wellsite parameters about the wellsite. The sensor package 456 may include one or more sensors (e.g., magnetometer, accelerometer, gyroscope, etc.), gauges (e.g., temperature, pressure, etc.), or other measurement devices. Data collected from the sensor package 456 and/or scanner 466 may be stored in memory 464 in the equipment and/or base units 131, 133.

The power supply 458 may be a battery, storage unit, or other power means capable of powering the equipment and/or base units 131, 133. In some cases, the power 458 may be passed via the communication links 128 between the equipment and base units 131, 133. The power may be carried internally within the equipment and/or base unit(s) 131, 133 and/or be external thereto. For example, the base unit 133 of the ROV 135 of FIG. 1 may be attached to one or more of the equipment and/or base units 131, 133 and provide power (and/or other signals) thereto via the communication link 128.

While specific electrical components are depicted, the equipment unit 131 and the base unit 133 may have various combinations of one or more electrical components to provide power, communication, data storage, data collection, processing, and/or other capabilities. The detection system 130 may be provided with other devices, such as switches, timers, connectors, and/or other features to facilitate communication. The processors and/or controllers may be provided to selectively activate the well site component and/or the well site equipment herein.

Figure 6B:
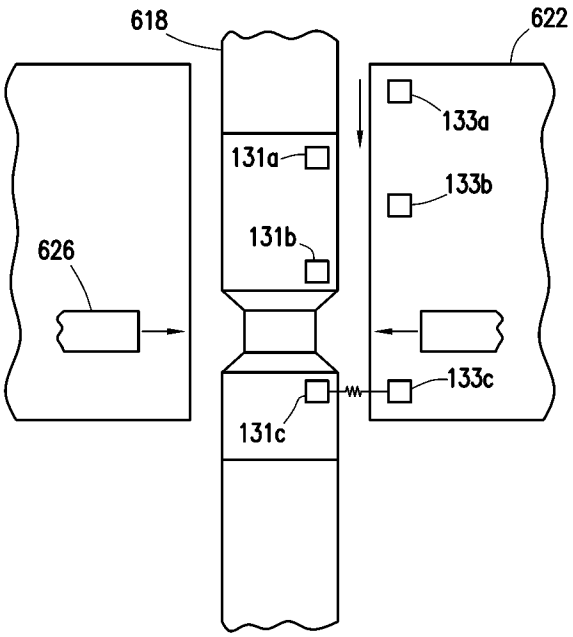
FIGS. 6A-6D are schematic views depicting a sequence of operation of the wellsite detection system.
Figure 6A:
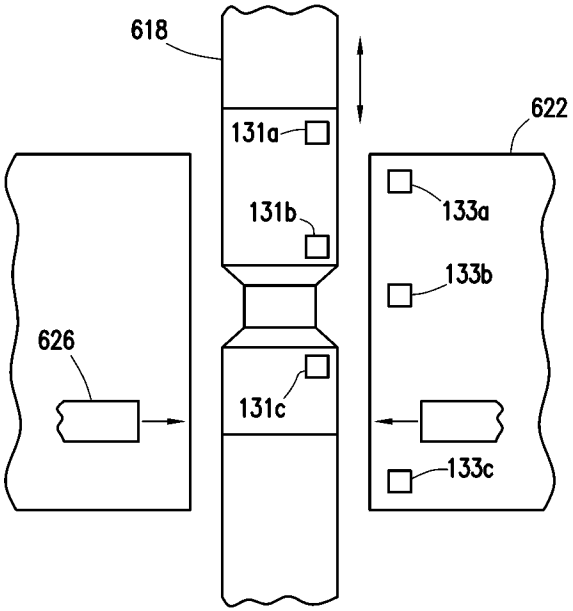
Figure 6D:
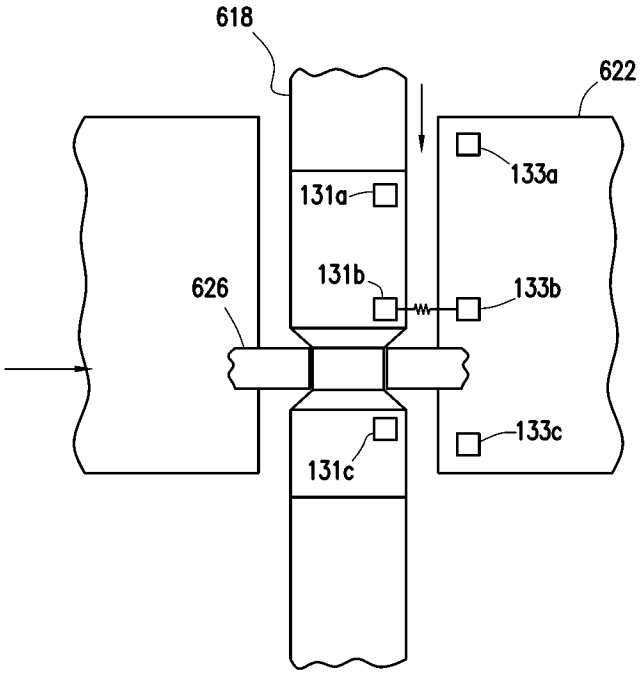
Figure 6C:
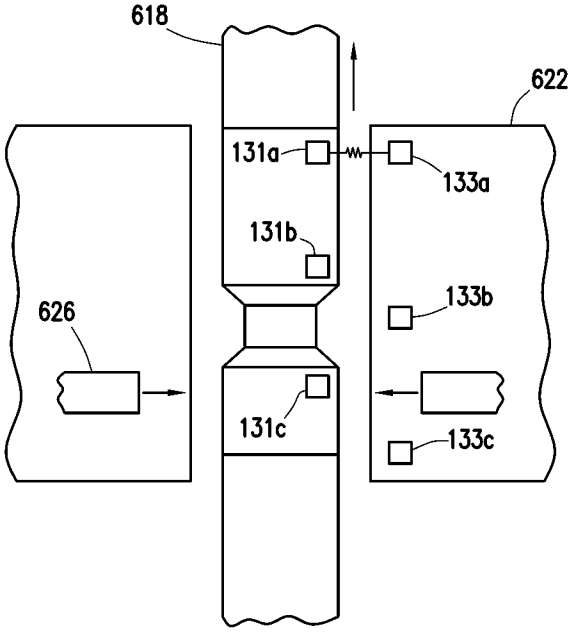

FIGS. 6A-6C depict an example operation sequence for detecting the equipment units 131*a-c* carried by a wellsite component 618 using a base unit 133*a-c* located about a wellsite location 622. As shown, the wellsite component 618 may be tubulars (e.g., 318*a-c* of FIGS. 3A-3C) carrying equipment units 131*a-c*, and the wellsite location 622 may be a BOP, LMRP or other wellsite component 618 with the base units 133*a-c* thereon. The wellsite location 622 may be provided with activation means 626, such as blade seals, fingers, or other devices (see, e.g., 226*a-c* of FIG. 2) of a BOP, engageable with the wellsite component 618. The well site component 618 has the equipment units 131*a-c* extending from an uphole end to a downhole end thereof.

In this example, the equipment units 131*a-c* are used to locate and position the wellsite component 618. As shown by these figures, the equipment units 131*a-c* are detectable by the communication units 133*a-c* as they move thereby. The equipment units 131*a-c* may be detectable by the base units 133*a-c*, for example, by sending a signal readable by the base units 133*a-c*. The equipment units 131*a-c* may be provided with a range of detection capabilities such that they are detectable when positioned adjacent a base unit 133*a-c* and/or a distance therefrom.

In the sequence shown, FIG. 6A shows the wellsite component 618 with the equipment units 131*a-c* in a misaligned position uphole from the base units 133*a-c*. In this position one or more of the base units 133*a-c* may be able to communicate with the equipment units 131*a-c* and determine that they are not in an aligned position relative thereto. For example, the base units 133*a-c* may be able to detect a distance between the equipment units 131*a-c* and the base units 133*a-c*, as well as a direction, location or other positioning information. The base units 133*a-c* may also gather information from the equipment units 131*a-c*, such as the type of equipment and its specifications.

FIG. 6B shows the wellsite component 618 with the equipment units 131*a-c* in a misaligned position downhole from the base units 133*a-c*. The wellsite component 618 may be moved until at least one of the base units 133*a-c* indicates alignment with one or more of the equipment units 131*a-c*. In the position of FIG. 6B, the wellsite component 618 has advanced downhole such that equipment unit 131*c* is aligned with base unit 133*c* thereby identifying a location of a downhole end of the well site component 618 relative to the wellsite location 622.

FIG. 6C shows the wellsite component 618 advanced uphole until another of the base units, namely uphole base unit 133*a*, indicates alignment with one or more of the equipment units, namely equipment unit 131*a*. In the position of FIG. 6C, the wellsite component 618 has advanced uphole such that equipment unit 131*a* is aligned with base unit 133*a* thereby identifying a location of an uphole end of the wellsite component 618 relative to the wellsite location 622.

The information gathered by detection using the base units 133*a-c* in FIGS. 6A-6D may be used to determine information about the wellsite component 618 and its position about the wellsite location 622. Detection of the uphole equipment unit 131*a* by the base unit 133*a* and the downhole equipment unit 131*c* by the base unit 133*c* (and/or other information gathered from the equipment units 131*a-c*) may be used to provide a mapping of the wellsite component 618 and/or a location of the wellsite component 618 relative to the well site location 622.

Information from the equipment units 131*a* and/or about the wellsite component 618 may be used, for example, to place the wellsite component 618 in a desired position about the wellsite location 622. For example, in a case where the wellsite component is a tubular (e.g., 318*a,b* of FIGS. 3A, 3B), placement of the tubular about a BOP (e.g., 122 of FIGS. 1 and 2) may be useful to place a thinner portion of the tubular relative to blades 626 of the BOP. Thinner portions of the tubular may be easier to cut than thicker portions of the BOP thereby facilitating severing and/or sealing the wellbore during a blowout and/or other incident.

As shown in FIG. 6D, the wellsite component 618 may be moved up or down to a desired activation position. Based on the information provided by detection of the wellsite component 618, the equipment units 131*a-c* may be placed in an aligned position about the base units 133*a-c*. As shown, the wellsite components 618 are positioned relative to blades 626. Once in a desired activation position, such as with a narrowest portion of the tubular 618 adjacent the blades 626 as shown, the blades 626 may be engaged as indicated by the arrows.

The blades 626 and/or other equipment and/or components may be selectively activated by one or more controllers and/or processors of the surface unit, wellsite component, and/or well site equipment. While blades 626 are depicted for severing along a narrowed portion of the well site component 618, any portion of the wellsite component 618 may be positioned at a desired location about wellsite location 622.

FIGS. 7 A-7D show additional configurations of the detection system 730 disposable about a wellsite component 718 and a wellsite location (e.g., BOP) 722. FIG. 7A shows a longitudinal view of the BOP 722 with the wellsite component 718 passing therethrough. FIG. 7B shows a radial cross-sectional view of the BOP 722 of FIG. 7A taken along line 7B-7B. FIGS. 7C and 7D show additional schematic views of the BOP 722.

As shown in FIGS. 7 A and 7B, the wellsite component 718 is a tubular deployable through a passage 736 of a BOP 722. Wellsite component 718 may have one or more equipment units 131 disposed thereabout. The BOP 722 has base units 133*a-d* disposed radially thereabout to detect the wellsite component 718.

As demonstrated by this configuration, the base units 133*a-d* may act as distance sensors to determine a distance of the wellsite component 718 therefrom. Each base unit 133*a-d* may detect a distance d1-d4 to determine a radial position of the wellsite component 718 in the passage 736. One or more equipment and base units 131, 133*a-d* can be added as desired (e.g., to detect smaller diameter objects in the BOP).

The base units 133*a-d* may be provided with sensors or sensor packages (see, e.g., 456 of FIG. 4) with measurement (e.g., magnetic resonance and/or acoustic) capabilities to detect distance and/or to determine a diameter D of the wellsite component 718. For example, if the base units 133*a-d* are at a position 10 feet (3.048 m) above rams 729 in the BOP 722, when a portion of the tubular 718 detected by the base units 133*a-d* moves 10 feet (3.048 m) downward, the tubular 718 may be in the path of the ram 729. The base units 133*a-d* may also be used to detect a tool joint or other item on the tubular 718 that may affect (e.g., interfere) with operation of the rams 729. Upon detection of a portion of the tubular 718, such as a tool joint, the wellsite component 718 may be selectively moved relative to the ram 729 to avoid engagement with portions of the wellsite component 718 that may be more difficult to sever.

FIGS. 7A-7D show one or more of the base units 133*a-e* may be positioned at one or more depths. As shown in FIGS. 7 A and 7B, base units 133*a-d* are positioned in discrete locations about the BOP 722 in a radial pattern at 0, 90, 180, and 360 degrees at a given depth along the BOP 722. The base units 133*a-d* may line the inner surface of the passage of the BOP 722. Additional base units 133*e* are also shown at different depths.

Figure 7B:
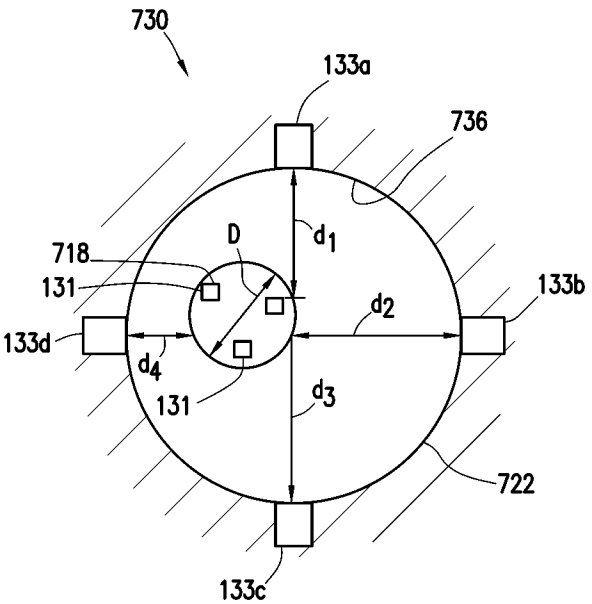
FIGS. 7 A and 7B show longitudinal and horizontal schematic views of another configuration of the wellsite detection system.
FIGS. 7C and 7D show schematic views of additional configurations of the wellsite detection system.
Figure 7A:
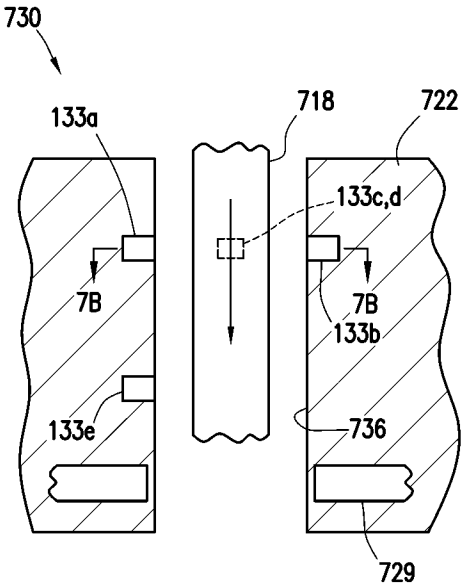
Figure 7C:
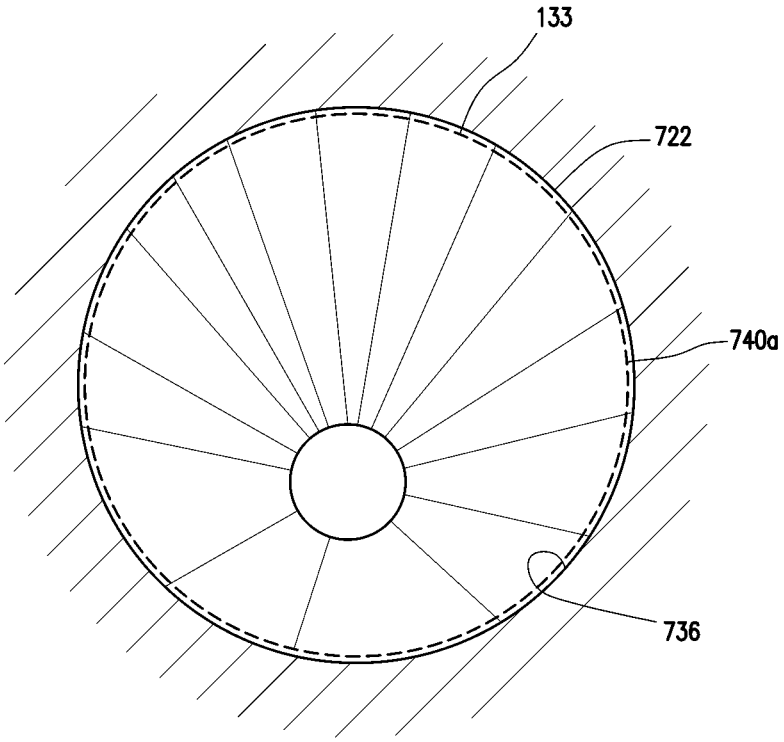
Figure 7D:
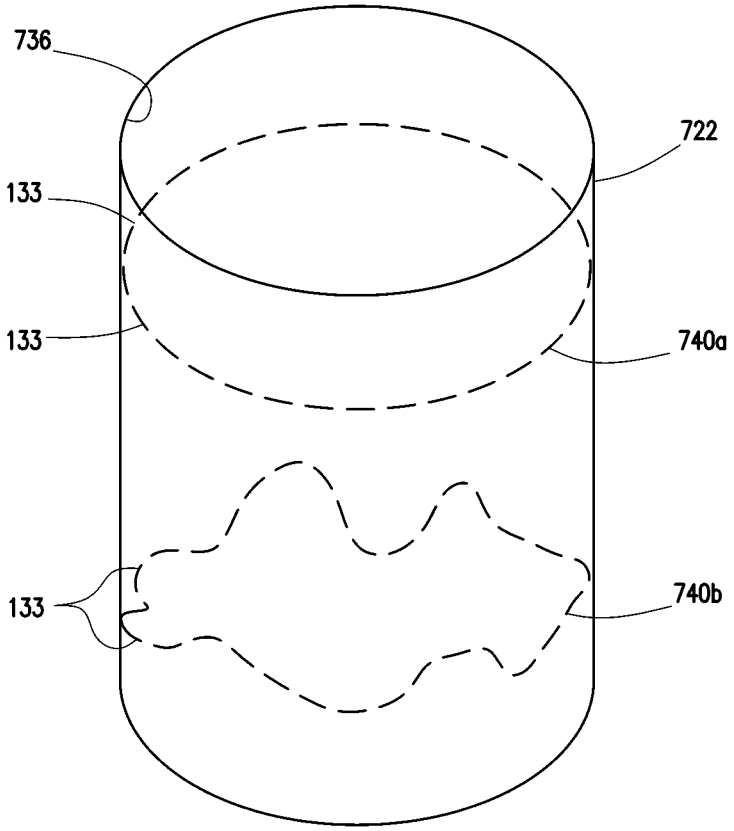

As schematically shown in FIG. 7C, a continuous set of the base units 133 may be positioned about an inner surface of the BOP 722 and form a circular array 740*a* of the base units 133 about passage 736. As schematically shown in FIG. 7D, the base units 133 may be positioned in any shape, such as the continuous circular array 740*a* defining a circular pattern along passage 736, or the irregular array 740*b* along passage 736.

One or more of the base units 133, 133*a-e* may be provided with scanning capabilities such that, as the wellsite component 718 moves through the passage 736, a picture (e.g., 3D image) may be generated by mapping the wellsite component 718 as it passes the base units 133, 133*a-e*. For example, the base units 133 may include the scanners 466 in the form of, for example, an array of magnetic resonance sensors mounted radially about the bore as shown in FIGS. 7C and 7D to detect the tubular as it passes therethrough. The scanners 466 of the base units 133, 133*a-e* may be used alone or in conjunction with the equipment units 131.

Each of the magnetic resonance sensors 466 can detect the outer surface of the tubular and combine to generate an image based on data received from each individual sensor 466. The scanners 466 may collect and process the images using the memory and storage of the base unit 133 and images may be communicated to the surface unit 110 via communicator 460 (FIG. 5). This image can identify the shape and location of the tubular as it passes through the wellbore. A 3D image may be generated of the tubular. These scans may be combined with information gathered from one or more sensors, RFIDs, memory, and/or other information. These scans may be compared and/or validated with known information about the tubulars, such as other scans and/or measurements performed using other equipment. Examples of scanners usable to image equipment are commercially available from SALUNDA at www.salunda-.com.

The base units 133, 133*a-e* may also be used to measure parameters of the wellsite component 718, such as diameter, distance, dimension, and/or other parameters. Examples of other scans and/or measurements that may be performed are available in US 2012/0160309 and/or 62/064,966, previously incorporated by reference herein.

One or more techniques may be used to detect a position of a wellsite component 718 about a wellsite, such as those described herein. Other techniques may also be used. For example, one or more of the equipment unit 131 of the wellsite component 718 may be an RFID tag that provides last inspection data to know the exact dimensions. Dimensions may be measured and/or stored for access during operations.

With known dimensions, a position of any wellsite component 718 that is deployed downhole may be estimated by counting the number of wellsite components 618 and calculating the overall length of the tool string. In another example, the BOP (e.g., annular 226*a* of FIG. 2) can be engaged to 'feel for' a tool joint and/or raised portion along the tool string.

One or more of the techniques used to detect and/or locate the wellsite component may be compared to confirm a position. This information may be fed back to the operator to confirm/revise estimates, to validate, and/or to otherwise analyze well site operations. These various outputs may be visible to the operator by feedback to a display on or offsite.

The data gather from the base units 133, 133*a-e* and/or other data sources may be processed (e.g., by the processor 462 of FIG. 5) to generate various outputs, such as a dimensions and/or position of the wellsite component. This information may be used along with the measurement of the length of the string, top drive position, a position of collars and/or tools along the tubular 718. These outputs may be analyzed, processed, communicated, and/or displayed to the user.

Figure 8:
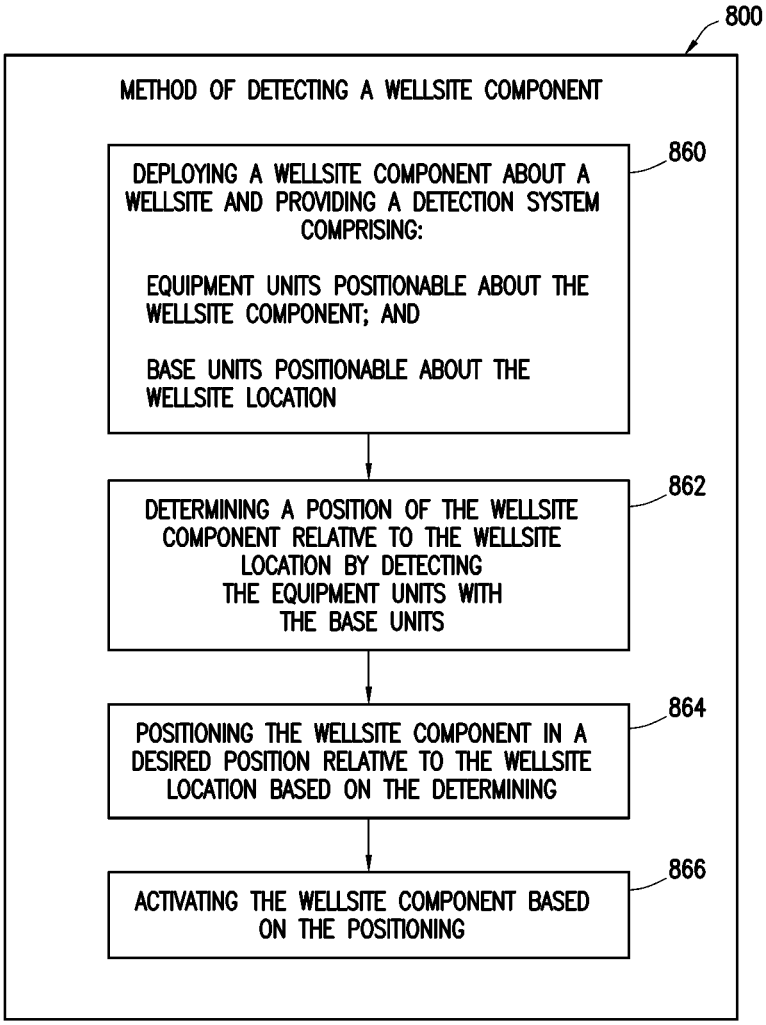
FIG. 8 is a flow chart depicting a method of detecting a wellsite component.

FIG. 8 depicts a method 800 of detecting a wellsite component. The method 800 involves 860—deploying a wellsite component about a wellsite location and providing a wellsite detection system. The detection system comprises equipment units positionable about the well site component and base units positionable about the wellsite location. The method 800 also involves 862 determining a position (e.g., radial and/or longitudinal) of the wellsite component relative to the wellsite location by detecting the equipment units with base units, and 864 positioning the wellsite component in a desired position relative to the wellsite location based on the determining.

In another example, the method may involve positioning a tubular relative to sealing means of a BOP and engaging (e.g., severing and/or sealing) a narrow portion of the tubular with the sealing means. The method may also involve other activity, such as 866 activating the well site component based on the positioning, scanning the well site component with the equipment units, and/or collecting information from the equipment units. Activating may involve, for example, engaging a desired portion of the well site component based on the positioning. Various combinations of the methods may also be provided. The methods may be performed in any order, or repeated as desired.

Example

In an example, the detection system is used to image a deployable tool and determine, for example, its position relative to a BOP. The deployable tool includes a drilling tool deployed from a surface location via a drill string comprising a series of metal drill pipe (see, e.g., FIGS. 3A-3B). The BOP has a bore to receive the deployable tool therethrough (see, e.g., FIG. 2).

The BOP has base units postioned about the bore (see, e.g., FIGS. 2, 6A-6D, 7A 7D). The base units include conventional nuclear magnetic resonance scanners, such as those commercially available from SALUNDA™, capable of detecting the outer surface of the deployable tool and generating an image thereof. A first set of base units are positioned radially about the bore of the BOP at 0, 90, 180 and 270 degrees around the passage at a first depth and a second set are positioned at a different depth in the bore (see, e.g., FIGS. 7 A and 7B).

Each scanners generates images of the downhole tool from its individual perspective. The combined output from these scanners is stored in memory and communicated view communicator to the surface unit (see, e.g., FIG. 5). One or more are collected as the deployable tool passes by the scanner(s). The combined scans are processed via processor and used to generate a 3D image of the deployable tool.

The scanners also detect a distance to the downhole tool (see, e.g., FIG. 7B). The distance is also used to determine the shape and location of the drill pipe as it passes through the BOP. These distances are processed to detect a narrowed portion along the deployable tool (see, e.g., FIGS. 6A-6D).

The scanned data is fed back to the surface unit and the position of the deployable tool is adjusted to locate the narrowed portion adjacent a sealing component of the BOP. The BOP is then activated to engage (sever and seal) around this narrowed portion of the drill pipe.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more well site components, well site locations, equipment units, base units and/or other features may be used for storing, collecting, measuring, and/or communication data.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A detection system for an offshore wellsite, the offshore wellsite including a surface system disposed at a surface of a body of water and a subsurface system disposed below the surface of the body of water, the surface system including a surface rig and a surface unit, the subsurface system including a conduit having a longitudinal axis and extending from the surface rig, a subsea blowout preventer (BOP) coupled to a lower end of the conduit, and a wellhead disposed at a bottom of the body of water and coupled to the subsea BOP, the detection system comprising:

a wellsite component deployable from the surface rig through the conduit to the subsea BOP, wherein the subsea BOP includes a bore to receive the wellsite component therethrough, wherein the subsea BOP is configured to seal a wellbore extending from the wellhead;

a plurality of axially spaced equipment units disposed along the wellsite component; and a plurality of axially spaced base units positioned along the bore of the subsea BOP, wherein each base unit is configured to detect each of the equipment units when the equipment units are positioned proximal the base units, and wherein the base units are configured to communicate with the equipment units to determine whether one of the equipment units is axially aligned with one of the base units to position the wellsite component in a desired axial location relative to the subsea BOP.

2. The detection system of claim 1, wherein the equipment units are coupled to the surface unit by a communication link, wherein each of the equipment units comprises an identifier disposed about the wellsite component.

3. The detection system of claim 2, wherein the identifiers comprise radio frequency identifiers.

4. The detection system of claim 2, wherein the equipment units further comprise a sensor package configured to detect wellsite parameters.

5. The detection system of claim 2, wherein each of the base units further comprises a communicator.

6. The detection system of claim 5, wherein the communicator is in communication with at least one of the equipment units and the surface unit.

7. The detection system of claim 2, wherein each of the equipment units and each of the base units further comprises a power supply, a processor, and a memory.

8. The detection system of claim 1, wherein the wellsite component comprises at least one of a drill collar, drill pipe, casing, tool joint, liner, coiled tubing, production tubing, wireline, slickline, logging tool, wireline tool, drill stem tester, and a deployable tool.

9. The detection system of claim 1, wherein the wellsite component comprises a deployable tool.

10. The detection system of claim 1, wherein the base units are configured to store or process information received from the equipment units.

11. The detection system of claim 1, wherein the equipment units and the base units are configured to communicate information with each other.

12. The detection system of claim 1, wherein the base units are configured to contain or collect wellsite information.

13. The detection system of claim 1, wherein each base unit comprises a scanner.

14. The detection system of claim 13, wherein the scanners are configured to detect an outer surface of the wellsite component and generate combinable images of the wellsite component to produce a 3D image of the wellsite component when the wellsite component is positioned in the bore of the subsea BOP.

15. A method of detecting a wellsite component at an offshore wellsite, the offshore wellsite including a surface system disposed at a surface of a body of water and a subsurface system disposed below the surface of the body of water, the surface system including a surface rig and a surface unit, the subsurface system including a conduit having a longitudinal axis and extending from the surface rig, a subsea blowout preventer (BOP) coupled to a lower end of the conduit, and a wellhead disposed at a bottom of the body of water and coupled to the subsea BOP, the method comprising:

deploying a wellsite component from the surface rig through the conduit and into a bore of the subsea BOP, wherein the subsea BOP is configured to seal a wellbore extending from the wellhead, wherein the wellsite component includes a plurality of axially spaced equipment units disposed along the wellsite component, wherein the subsea BOP includes a plurality of axially spaced base units disposed along the bore of the subsea BOP;

detecting the equipment units with the base units when the equipment units are positioned proximal the base units;

communicating between the base units and the equipment units when the equipment units are positioned proximal the base units to determine whether one of the equipment units is axially aligned with one of the base units to position the wellsite component is in a desired axial location relative to the subsea BOP.

16. The method of claim 15, wherein each of the equipment units comprising an identifier.

17. The method of claim 15, further comprising engaging the wellsite component with the subsea BOP.

18. The method of claim 17, wherein the engaging comprises sealing about the wellsite component.

19. The method of claim 18, wherein the engaging comprises severing the wellsite component based on the axial alignment of one of the equipment units with one of the base units.

20. The method of claim 18, further comprising adjusting a position of a narrowed portion of the wellsite component relative to the subsea BOP, and wherein the engaging comprises engaging the narrowed portion of the wellsite component with the subsea BOP.

* * * * *